US005319916A

United States Patent [19]

Ritt et al.

[11] Patent Number: 5,319,916

[45] Date of Patent: Jun. 14, 1994

[54] VALVE STEM POLISHING METHOD

[75] Inventors: Robert T. Ritt; Bernard J. Luurtsema, both of Holland, Mich.

[73] Assignee: K-Line Industries, Inc., Holland, Mich.

[21] Appl. No.: 3,285

[22] Filed: Jan. 12, 1993

Related U.S. Application Data

[60] Division of Ser. No. 942,350, Sep. 9, 1992, Pat. No. 5,218,788, which is a continuation of Ser. No. 595,282, Oct. 9, 1990, abandoned.

[51] Int. Cl.[5] ..... B24B 1/00

[52] U.S. Cl. ..... 51/289 R; 51/105 VG; 51/238 GG; 51/237 R; 51/241 VS

[58] Field of Search ..... 51/105 VG, 103 R, 105 R, 51/165.74, 165.76, 216 T, 236, 237 R, 238 R, 238 S, 238 GG, 241 VS, 281 R, 289 R

[56] References Cited

U.S. PATENT DOCUMENTS

| | | | |
|---|---|---|---|
| 2,424,160 | 7/1947 | Greene . | |
| 2,801,499 | 8/1957 | Jones | 51/103 WH |
| 3,457,576 | 7/1969 | Yarrow | 15/21 |
| 3,729,300 | 4/1973 | Mackay et al. | 51/103 |
| 3,835,589 | 9/1974 | Silverman | 51/103 WH |
| 4,043,767 | 8/1977 | Suda | 51/103 WH |
| 4,094,107 | 6/1978 | Naul | 51/103 WH |
| 4,332,110 | 6/1982 | Flinchbaugh | 51/165.78 |
| 4,412,401 | 11/1983 | Fundell | 51/99 |
| 4,428,160 | 1/1984 | Willemsen et al. | 51/241 VS |
| 4,860,499 | 8/1989 | Dinger et al. | 51/103 WH |
| 4,987,701 | 1/1991 | Humbert | 51/105 VG |
| 5,070,653 | 12/1991 | Amundsen | 51/105 VG |

FOREIGN PATENT DOCUMENTS

| | | | |
|---|---|---|---|
| 218545 | 8/1990 | Japan | 51/238 GG |

OTHER PUBLICATIONS

European Search Report.

Machine Design vo. 52, No. 5, Cleveland, Ohio, USA p. 68; Scanning For Ideas; 'Top-Mounted Wheel Grinds Precision Parts'.

K-Line Bulletin #685 disclosing Model KL4575 valve stem grinder marketed by the assignee of the above identified application; Oct. '85.

Photocopies of photographs showing a K-Line Model KL4575 valve grinder marketed by the assignee of the above identified application; Oct. '85.

Fame Supply Company Bulletin disclosing a Model US1000 automatic valve stem polisher marketed by Fame Supply Company, date unknown.

*Primary Examiner*—M. Rachuba

*Attorney, Agent, or Firm*—Price, Heneveld, Cooper, DeWitt & Litton

[57] ABSTRACT

An apparatus and method for polishing combustion engine valves. The machine includes a rotating deburring wheel for on contact with the valve stem and a regulating surface which provides support and applies a rotational force to the valve stem. A pair of guide blades and a guide plate cooperate with the regulating surface to contain the valve stem when contacted by the deburring wheel. The guide blades are positioned at an angle with respect to the axis of rotation of the regulating surface to bias the valve in an inward direction against the guide plate during valve rotation. The machine further includes the use of a unique pivot point for the deburring wheel support so the deburring wheel contacts the valve stem approximately above the valve stem centerline regardless of valve stem diameter or variations in the diameter of the deburring wheel.

15 Claims, 3 Drawing Sheets

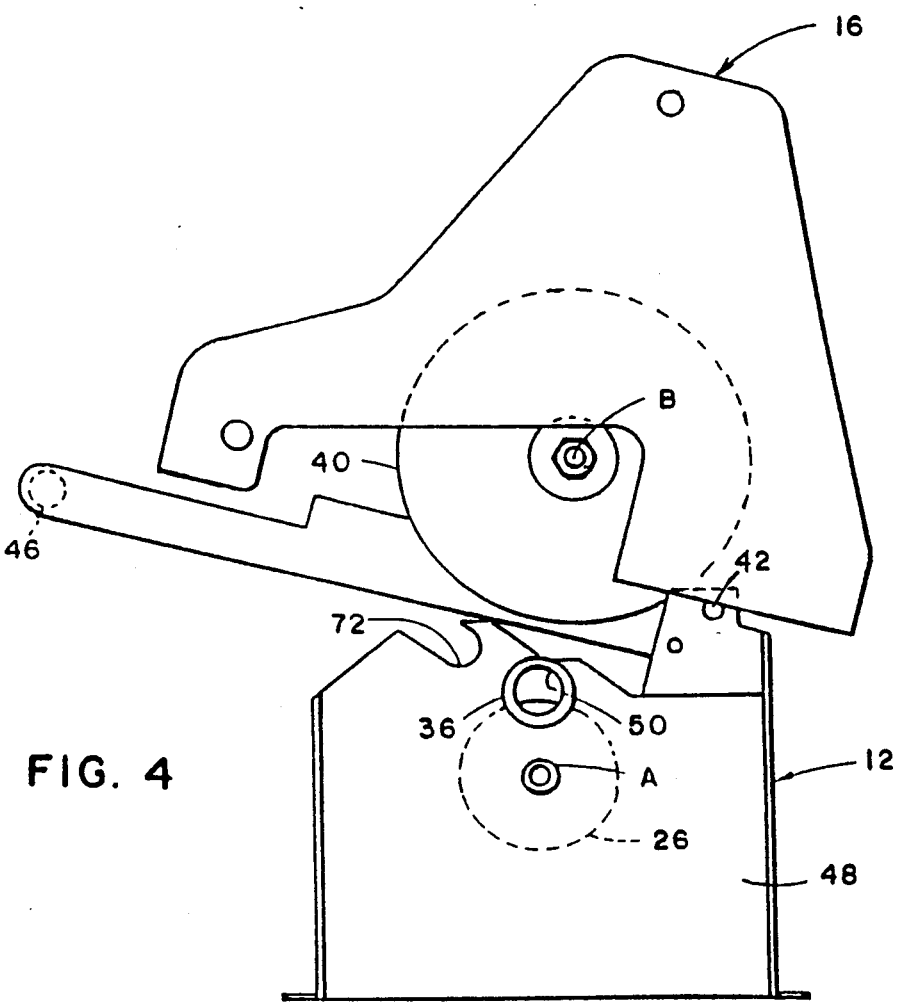
FIG. 4
FIG. 6
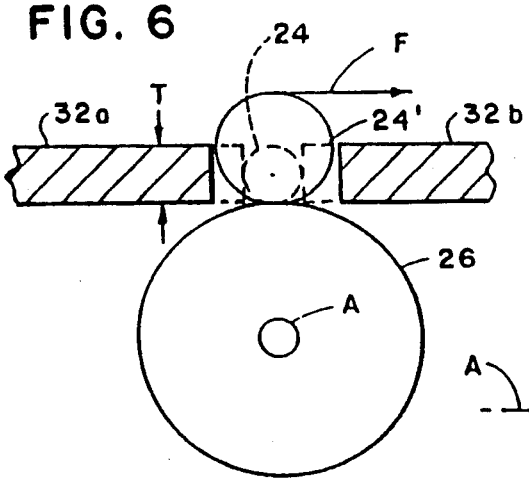
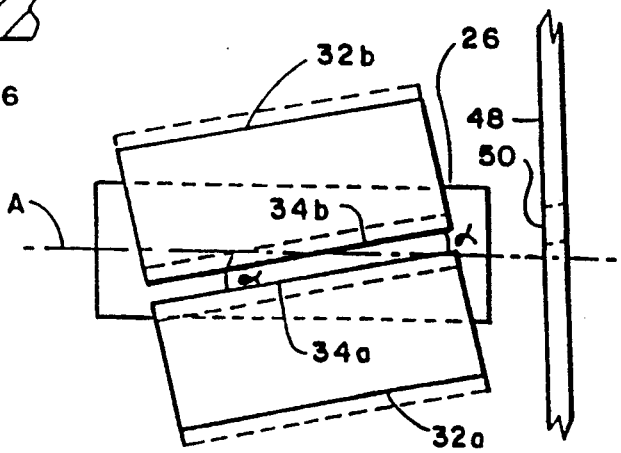
FIG. 5

VALVE STEM POLISHING METHOD

This is a division of application Ser. No. 07/942,350, filed Sep. 9, 1992, now U.S. Pat. No. 5,218,788 which is a continuation of application Ser. No. 07/595,282, filed Oct. 9, 1990, now abandoned.

BACKGROUND OF THE INVENTION

This invention relates generally to the polishing of metallic surfaces, and more particularly, to a method and apparatus for polishing the stem of an internal combustion engine valve.

Internal combustion engine valves have a tendency to become fouled in use. When such fouling sufficiently reduces the performance, the valves are removed and refurbished. The refurbishment includes removal of carbon deposits by batch cleaning of the valves. Such cleaning process tends to impart minute deformities in the valve surface. The valve surface must be restored to a predetermined finish prior to installing in an engine. One known technique is to grind the valve stems. This involves the removal of material from the valve stem surface which requires that a valve guide insert be positioned in the valve guide to accommodate the reduced valve stem diameter. Such method requires the additional material and labor expense of installing the valve guide inserts.

A long felt need has existed for a technique for polishing valve stems. In contrast to grinding, polishing is not intended to alter the dimensions of the article. Rather, the surface is restored close to its original finish without a substantial removal of material. A successful technique for polishing valve stems, however, has proved to be elusive. While polishing is not intended to remove surface material, prior attempts at polishing valve stems have either produced an out-of-round condition of the stem or a non-uniform stem diameter.

SUMMARY OF THE INVENTION

Accordingly, it is an object of the present invention to provide a method and apparatus for polishing valve stems in a manner that does not degrade the surface geometry of the valve. It is further an object to provide a valve stem polishing method and apparatus that is adapted to use by a small repair facility, such as a one-mechanic garage. As such, a method and apparatus according to the invention is fast and easy to use and readily accommodates valve stems of varying diameter.

An apparatus according to a first aspect of the invention includes a first rotating means in the form of a deburring wheel for contacting a valve stem surface and second rotating means positioned below the first rotating means for providing a regulating surface that both supports and applies a rotational force to a valve stem. A pair of guide blades, having spaced apart facing edge portions, cooperate with the regulating surface to contain a valve stem when contacted by the deburring wheel. Such an apparatus may additionally include a guide plate positioned laterally of the rotating means including a circular hole. The guide blades may be positioned at an angle with respect to the axis of rotation of the second rotating means in order to bias a valve extending through the circular hole against the guide plate to provide exceptional stability to the valve being polished.

According to another aspect of the invention, guide blade adjustment means are provided for adjustably separating the facing end portion of the guide blades at either of two selectable fixed distances. The two selectable spacings are sufficient to accommodate a wide range of valve diameters. Therefore, ease of use of the apparatus is imparted because the operator need only select one of two positions of an actuator.

According to yet another aspect of the invention, the axis of rotation of the first rotating means is pivoted about a pivot axis adjacent the deburring wheel such that the deburring wheel contacts the top portion of the valve stem by pivoting the deburring wheel about the pivot axis. The pivot axis is preferably positioned such that the surface portion of the deburring wheel contacts the stem approximately directly above the center line of the valve stem regardless of either the diameter of the valve stem being polished or variations in diameter of the deburring wheel, which varies according to degree of wear. In a most preferred embodiment of the invention, the deburring wheel has a width that is substantially equal to the length of a typical valve stem so that the valve stem may be polished with a single motion.

These and other objects, advantages and features of this invention will become apparent upon review of the following specification in conjunction with drawings.

BRIEF DESCRIPTION OF THE DRAWINGS

FIG. 4 is a side elevational view taken from the right side of the apparatus in FIG. 2;

FIG. 5 is a top plan view taken along the lines V—V in FIG. 2;

FIG. 6 is a diagram similar to the view in FIG. 3 illustrative of a principle of the invention.

DESCRIPTION OF THE PREFERRED EMBODIMENT

Figure 2:
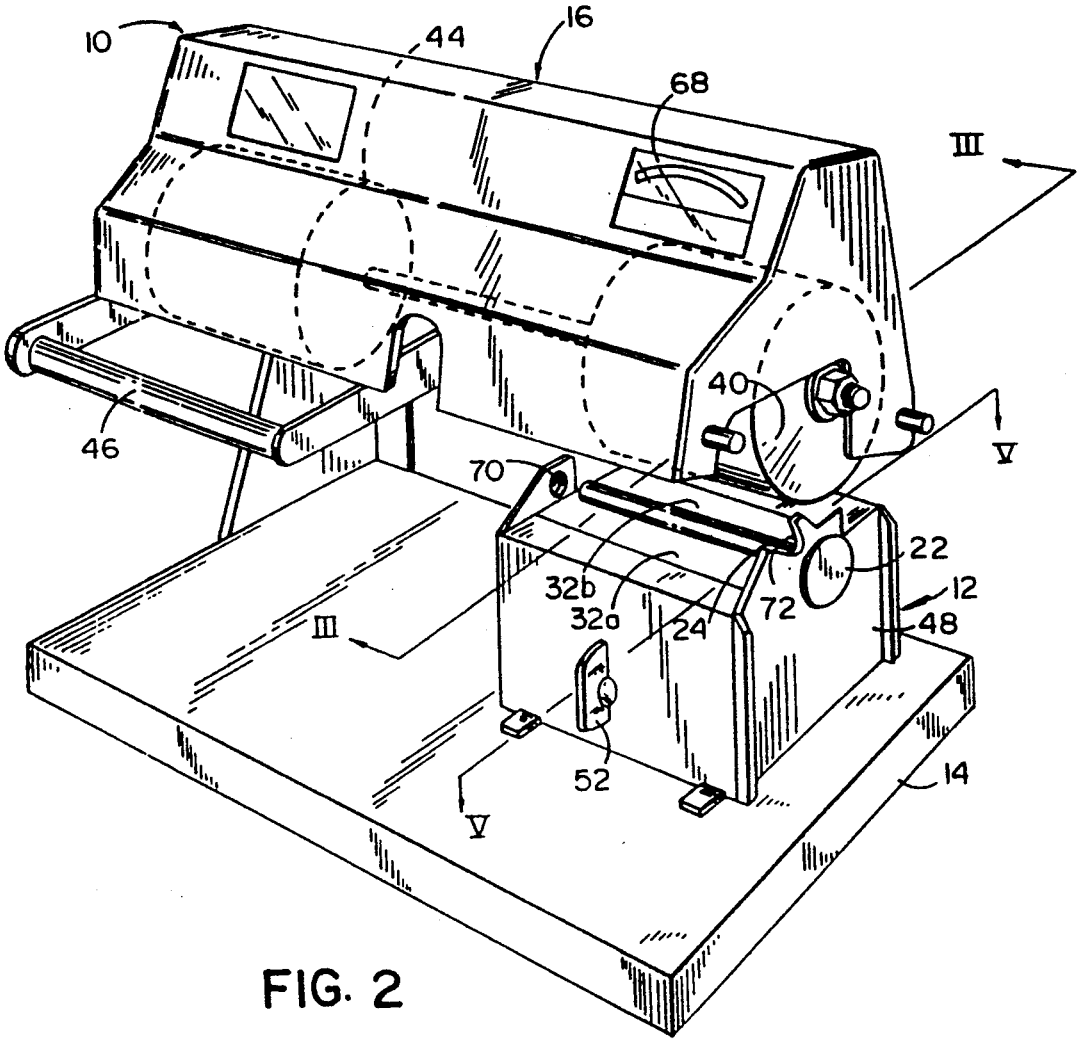
FIG. 2 is a perspective view taken from the front and right side of an apparatus according to the invention.
Figure 1:
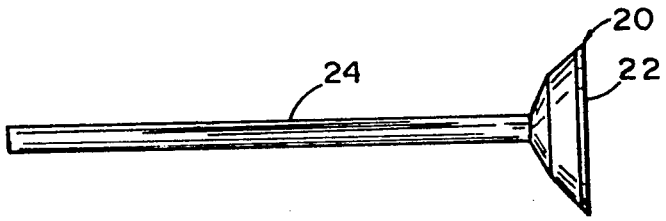
FIG. 1 is a side view of an internal combustion engine valve to which the invention is to be applied.

Referring now specifically to the drawings, and the illustrative embodiments depicted therein, a valve stem polishing apparatus generally shown at 10 includes a valve support and regulating mechanism 12 mounted to a base 14 and a polishing member 16 pivotally mounted to base 14 above valve support and regulating mechanism 12 (FIG. 2). The purpose of apparatus 10 is to polish the stem of a valve 20 having a circular valve seat 22 and circular valve stem 24 extending from the valve seat (FIG. 1). Because dimensional variations resulting from the removal of surface material from seat 22 may be accommodated by common valve adjustment techniques, there does not exist a need to polish valve seat 22 which may be refurbished by conventional grinding techniques.

Figure 3:
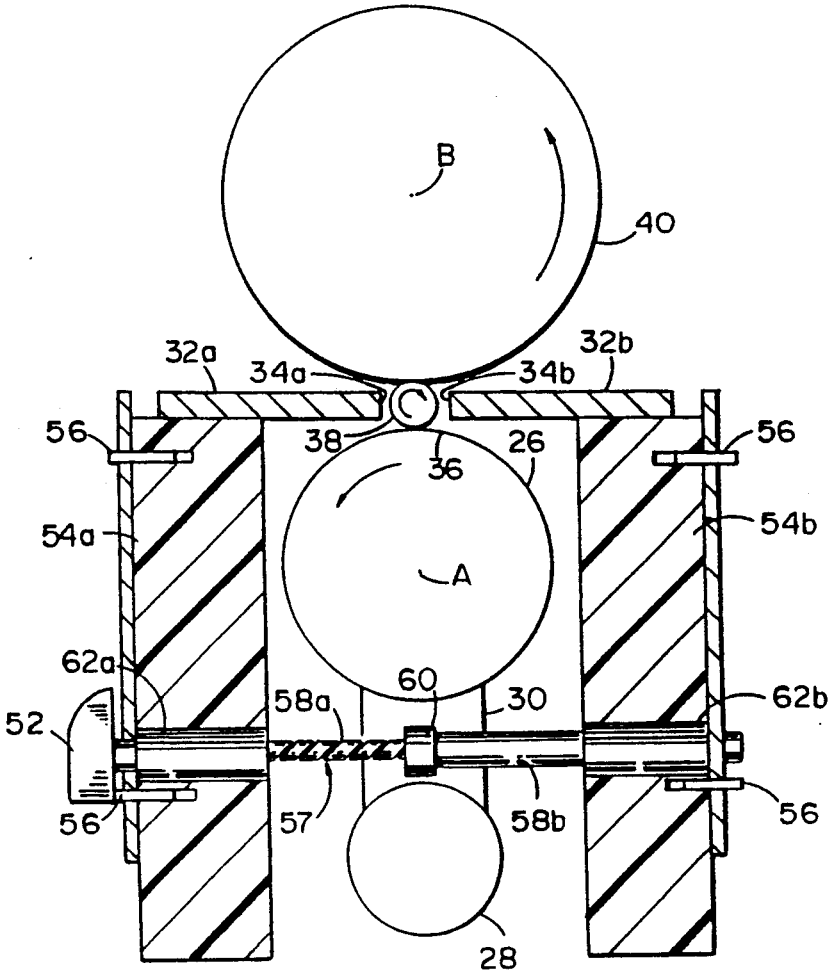
FIG. 3 is a sectional side elevation taken along the lines III—III in FIG. 2.

Valve support and regulating mechanism 12 includes a regulating wheel 26 which is rotated counterclockwise, as viewed in FIG. 3, by a motor 28 through a drive mechanism 30. A pair of guide blades **32*a*, 32*b* positioned above regulating wheel 26 include facing edge portions 34*a*, 34*b* which are spaced apart to define, in combination with an upper surface 36 of wheel 26, a confinement cavity, generally shown at 38 for positioning valve stem 24 during the polishing process. Confinement cavity 38 is laterally bordered on one side by a vertical guide plate 48. Guide plate 48 includes an opening 50 aligned with confinement cavity 38 and having a diameter that is sufficiently large to accommodate any size valve stem 24 but smaller than the diameter of valve seat 22 (FIGS. 2, 4 and 5**).

Positioned above confinement cavity 38 is a rotating polishing wheel 40, which rotates counterclockwise, which is the same direction of rotation as regulating wheel 26. As will be set forth in more detail below, rotation of valve stem 24 is determined substantially entirely by the rotation of regulating wheel 26. Accordingly, valve stem 24 rotates clockwise such that its upper surface is moving in the same linear direction as the surface portion of polishing wheel 40 contacting the valve stem. However, the surface velocity of wheel 40 is greater than that of regulating wheel 26, and hence valve stem 24, such that there is relative movement between the contacting surfaces of polishing wheel 40 and valve stem 24. Polishing wheel 40 is mounted within polishing member 16 which is pivotally mounted by a pivot 42 with respect to base 14. The purpose of this arrangement is to allow an operator to bring polishing wheel 40, which is rotated by a motor 44, into contact with a valve stem 24 positioned within confinement cavity 38. Such pivotal movement of polishing member 16 may be accomplished by applying vertical downward force on a user handle 46 (FIG. 2).

As best seen in FIG. 5, which is exaggerated for illustration purposes, guide blades 32*a*, 32*b* are angularly offset from axis A, about which regulating wheel 26 is rotated, by angle $\alpha$ such that facing edge portions 34*a*, 34*b* are likewise angularly offset from axis A. In this manner, a valve stem extending through opening 50 and positioned between facing edge portion 34*a*, 34*b* will be biased against plate 48, or to the left as viewed in FIG. 5, because the angular orientation of confinement cavity 38 positions the valve stem at a slight angular offset from the regulating wheel 26. The angular offset imparts a lateral force on the valve stem to pull it against the guide plate. This provides lateral stability to the valve stem to prevent "walking". In the illustrated embodiment $\alpha$ is one (1) degree.

Guide blades 32*a*, 32*b* may be positioned as shown in the solid lines FIG. 5 and the phantom lines in FIG. 6 in order to polish valve stems of a relatively small diameter, such as $\frac{1}{4}$ to $\frac{3}{8}$ inch, or spaced a second distance, as shown in phantom in FIG. 5 and solid lines in FIG. 6 in order to polish valves having a larger stem diameter such as from $\frac{3}{8}$ to $\frac{1}{2}$ inch. As best seen by reference to FIG. 6, guide blades 32*a*, 32*b* have a thickness T that is preselected to be sufficiently small to allow polishing wheel 40 to engage the surface of a valve stem 24 having a minimum diameter but yet sufficiently thick to retain a valve stem 24' having a maximum diameter, which is more than half the thickness of the maximum stem diameter. In the illustrated embodiment, guide blades 32*a*, 32*b* have a nominal thickness T of 0.1345 inch.

In order to enhance the ease of operation of polishing apparatus 10, guide blades 32*a*, 32*b* are capable of substantially two spacings under the control of a manual actuator 52. Actuator 52 is movable through a 90° arc in order to space the guide blades in one of two positions. Guide blades 32*a*, 32*b* are mounted to positioning blocks 54*a*, 54*b* which are guided in lateral movement by guide pins 56 (FIG. 3). Movement of positioning blocks 54*a*, 54*b* is effected by a shaft 56 having a shaft portion 58*a*, which is directly connected to actuator 52 and a shaft portion 58*b* which is coupled to shaft portion 58*a* by a coupling 60. Shaft portion 58*a* engages positioning block 54*a* through a $\frac{5}{8}$ by 4 triple-lead thread 62*a* and shaft 58*b* engages positioning block 54*b* through a lead thread 62*b* having the same dimensions as lead thread 62*a* except of the opposite hand. In order to provide selective coupling of 58*a* and 58*b*, the shafts nest and are not splined. Accordingly, infinite relative adjustment is available. Once alignment is made, coupling 60 is applied in order to retain alignment between the shaft portions. The use of triple lead threads 62*a*, 62*b* to couple shaft 56 to positioning blocks 54*a*, 54*b* provides sufficient lateral movement of the positioning blocks for a relatively small amount of rotation of shaft 56. This allows the user to select between valves by a mere 90° rotation of actuator 52. In the illustrated embodiment, blocks 54*a*, 54*b* are made from a polymeric material.

Figure 7:
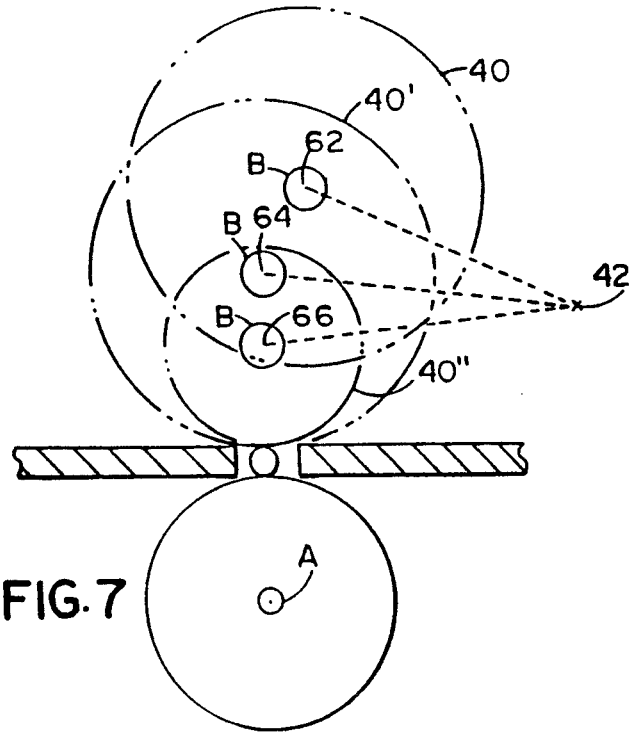
FIG. 7 is a diagram similar to the view in FIG. 3 illustrative of another principle of the invention.

In order to prevent a valve from chattering during the polishing process, it is necessary to keep the force vector F applied to the valve stem from polishing wheel 40 either downward or substantially horizontal as shown in FIG. 3. Any upward force vector would tend to create chatter. There are several factors that complicate a successful design. The present use of two discrete positions for guide plates 32*a*, 32*b* results in substantial spacing between certain diameter valve stems and the edge portions 34*a*, 34*b* of the guide blades. Furthermore, polishing wheel 40 varies in diameter significantly between a new condition and a worn condition. In order to ensure that force vectors imparting by the polishing wheel on the valve stem are horizontal or downwardly pointing, it is necessary to have the most downward point of the polishing wheel contact the most upward point of the stem. Although this could be accomplished by mounting polishing wheel 40 such that it is limited to only vertically reciprocating upward and downward motion, such mounting would require a complicated parallelogram mechanism or the like. Another solution would be to mount polishing wheel 40 for pivotal motion about a pivot point that is an infinite distance from the polishing wheel. This solution is clearly impractical in a compact machine. However, it has been discovered that the objectives of providing only horizontal and downward force vectors on the valve stem from the polishing wheel may be obtained by positioning pivot 42 at the center of an imaginary circle defined by three points (FIG. 7): the first point 62 is the location of the axis of rotation B of wheel 40 when the wheel is new and in its rest position sufficiently above confinement cavity 38 to provide working clearances; the second point 64 is the location of axis B when the polishing wheel 40 is new and its surface is contacting a valve stem during the polishing operation; and the third point 66 is the location of axis B when polishing wheel 40'' is worn to its minimum useable diameter and is contacting a valve. By using point 62, 64, 66 to define a circle whose center is the location of pivot 42, polishing apparatus 10 may still be compact while providing exceptional performance. In the illustrated embodiment, point 42 is located such that the point of valve stem 24 contacted by polishing wheel 40 does not vary by more than $+/-\frac{1}{2}$ of a degree regardless of the working diameter of the polishing wheel or the diameter of the valve stem. This may be accomplished by positioning pivot 42 at a 4.18 inch radius from axis B, 4.20 inches behind the centerline seperating facing edge portions 34*a*, 34*b* and 1.83 inches above the centerline of a hypothetical ¼ inches valve stem being polished.

In the illustrated embodiment, regulating wheel 26 is 2⅜ inches in diameter and is made from a nitrile having a durometer of 65+/−5 shore A and is rotated at 70 rpm. Polishing wheel 40 is a grade 7A-fine deburring wheel manufactured by 3M Company under Model Scotch Brite SST, having a new diameter of 6 inches and a width of 6 inches. Polishing wheel 40, in the illustrated embodiment, may be used until it is worn to a diameter of 4 inches. Polishing wheel 40 is rotated at 1725 rpm by a ⅓ horsepower motor. The above provides relative surface speeds between the regulating wheel and the polishing wheel and appropriate coefficients of friction to ensure that the regulating wheel will have greater frictional engagement with the valve stem than the polishing wheel, while maintaining the speed of the regulating wheel to a level that allows easy loading and unloading of a valve stem.

In use, actuator 52 is placed in the appropriate position for the valve stem diameter to be polished. Each position accommodates a range of valve stem diameters. The valve is then inserted stem first through opening 50, which will place the valve stem in confinement cavity 38 in contact with upper surface 36 of regulating wheel 26. Regulating wheel 26 will rotate the valve stem and place a lateral force on the valve stem, resulting from the angular displacement of guide blades 32*a*, 32*b*, which will pull the valve until its seat is against vertical guide plate 48. With the valve stem fully loaded into the apparatus, the operator applies a downward force on handle 46 to bring polishing wheel 40 into contact with the valve stem. Polishing wheel 40 is sufficiently wide to polish most valve stems in one pass.

It has been discovered that individual users have a tendency to place significantly different downward forces on handle 46. If too much downward force is exerted, then motor 44 may eventually shut down temporarily due to a thermal overload. In order to avoid this, a meter 68 is provided in order to monitor the amperage, and hence the load, of motor 44. This encourages uniform application of polishing force by the operator. After a while, use of apparatus 10 results in an uneven surface to polish wheel 40. A dressing cylinder (not shown) may be inserted between opening 70 and an opposing saddle 72 in the housing of valve support and regulating mechanism 12. Such a dressing wheel will typically have an outer surface of silcon carbide. Once the dressing wheel is positioned between opening 70 and saddle 72, the user pulls down on handle 46 in a same manner as polishing a valve. However, the surface of wheel 40 will contact the dressing cylinder which will remove material from polishing wheel 40 to a uniform diameter across its width.

A method and apparatus according to the present invention does not remove a substantial amount of material from the valve stem, leaving the valve stem at its original diameter. This allows the refurbishing of an internal combustion engine valve without the necessity of a valve guide insert in order to accommodate a changed valve diameter. Valves may be polished by applying a single downward force by the operator and no more than a 90° turn of a selecting actuator to accommodate various valve stem diameters. This is accomplished without inducing chatter in the rotating valve notwithstanding the accommodation of various valve diameters and notwithstanding variations in the diameter of the polishing wheel. Because the valve stem is rotated without chucking or other such limiting means, an exceptionally uniform polishing effect is applied across the entire surface of the valve stem without a tendency to make the valve stem out-of-round. The invention may be embodied in a portable machine that is relatively inexpensive, and hence, suitable for use by a small repair facility.

Changes and modifications in the specifically described embodiments can be carried out without from the principles the invention, which is intended to be limited only the scope of the appended claims, as interpreted according to the principles of patent law including the Doctrine of Equivalents.

The embodiments of the invention in which an exclusive property or privilege is claimed are defined as follows:

1. A method for polishing a valve stem of an internal combustion engine valve having a stem an an enlarged seat at one end of said stem, said method including the steps of:

inserting a valve stem into an opening in a guide plate until the valve seat is adjacent said guide plate;

supporting said valve stem by a first rotating means having an outer surface adapted to regulate the rotation of said valve stem;

providing a pair of guide blades straddling said valve stem positioned therebetween to provide containment in cooperation with said guide plate during polishing;

pivoting the axis of rotation of a rotating deburring wheel about a pivot axis adjacent said deburring wheel; and contacting the top portion of said valve stem with said deburring wheel to polish said valve stem.

2. The method according to claim 1 in which said method includes monitoring the load applied to said deburring wheel during said contacting in order to apply the proper force of said deburring wheel to said valve stem.

3. The method according to claim 1 in which said method includes positioning said pivoting axis such that the surface portion of said deburring wheel, contacting said stem, is directly above the centerline of said valve stem regardless of valve stem diameter.

4. The method in claim 3 wherein said deburring wheel has a diameter that decreases as said deburring wheel wears and wherein said method includes positioning said pivoting axis such that said surface portion is directly above said centerline regardless of deburring wheel diameter.

5. The method according to claim 1 in which said method includes placing said guide blades at an angle relative to the axis of rotation of said first rotating means so that a force is produced tending to hold the seat of a valve against said guide plate.

6. The method according to claim 5 in which said method includes setting said angle at one degree.

7. A method for polishing the stems of internal combustion engine valves each valve having a stem and an enlarged head, said method comprising the steps of:

providing a first rotating means including a deburring wheel and means to engage said valve stem surface with said wheel;

applying a rotational force to said stem with a second rotating means located below said first rotating means and having a regulating surface to support said valve stem;

containing said valve stem when said first rotating means makes contact with said stem using two strips having spaced apart facing edge portions which receive said stem therebetween; and bringing said deburring wheel into engagement with the valve stem surface to polish the valve stem.

8. The method according to claim 7 in which said method includes rotating said first and second rotating means in the same direction.

9. The method according to claim 7 in which said method includes rotating said first and second rotating means at relative speeds in such that the coefficient of friction of said second rotating means will control rotation of the valve stem.

10. The method according to claim 7 in which said method includes positioning said first rotating means on a pivot arm to provide contact of said deburring wheel at a point directly over said valve stem centerline regardless of valve stem diameter.

11. The method according to claim 7 in which said method includes positioning said guide blades at an angle relative to the axis of rotation to provide a force holding said valve stem inward during rotation of said second rotating means.

12. The method according to claim 7 in which said method includes providing the width of said deburring wheel such that it is substantially the same length as the valve stem.

13. The method according to claim 11 in which said method includes the step of positioning said guide blades at a one degree angle.

14. The method according to claim 7 in which said method includes the step of determining the load on said first rotating means through the use of a load meter.

15. A method for polishing the stems of internal combustion engine valves each valve having a stem and an enlarged head, said method comprising the steps of:

providing a first rotating means including a deburring wheel and means to engage said valve stem surface with said wheel;

applying a rotational force to said stem with a second rotating means located below said first rotating means and having a regulating surface to support said valve stem;

containing said valve stem above said second rotating means when said first rotating means makes contact with said stem; and bringing said deburring wheel into engagement with the valve stem surface to polish the valve stem.

* * * * *